US005977924A

United States Patent [19]

Takei et al.

[11] Patent Number: 5,977,924

[45] Date of Patent: Nov. 2, 1999

[54] TEM SLOT ARRAY ANTENNA

[75] Inventors: Ken Takei, Hachioji; Hiroshi Kondoh, Fuchu, both of Japan

[73] Assignee: Hitachi, Ltd., Tokyo, Japan

[21] Appl. No.: 08/822,005

[22] Filed: Mar. 24, 1997

[30] Foreign Application Priority Data

Mar. 29, 1996 [JP] Japan ..... 8-075856

[51] Int. Cl.[6] ..... H01Q 13/10

[52] U.S. Cl. ..... 343/770; 343/700 MS; 343/767

[58] Field of Search ..... 343/767, 700 MS, 343/770, 771; H01Q 13/10

[56] References Cited

U.S. PATENT DOCUMENTS

| | | | |
|---|---|---|---|
| 3,691,563 | 9/1972 | Shelton | 343/771 |
| 4,054,874 | 10/1977 | Oltman | 343/700 MS |
| 5,006,858 | 4/1991 | Shirosaka | 343/700 MS |
| 5,181,042 | 1/1993 | Kaise et al. | 343/700 MS |
| 5,189,433 | 2/1993 | Stern et al. | 343/770 |
| 5,502,453 | 3/1996 | Tsukamoto et al. | 343/700 MS |

FOREIGN PATENT DOCUMENTS

| | | | |
|---|---|---|---|
| 2494047 | 5/1982 | France | 343/700 MS |
| 1-269302 | 10/1989 | Japan . | |
| 1-292903 | 11/1989 | Japan . | |
| 1-314405 | 12/1989 | Japan . | |
| 4-824405 | 3/1992 | Japan . | |

*Primary Examiner*—Don Wong
*Assistant Examiner*—Tho Phan
*Attorney, Agent, or Firm*—Antonelli, Terry, Stout & Kraus, LLP

[57] ABSTRACT

A novel planar antenna is capable of feeding power to a plurality of radiation elements at a low loss and has a construction suitable for mass production. The antenna comprises a multilayer substrate formed by laminating at least two dielectric substrates and having at least an upper layer, an intermediate layer and a lower layer, upper conductive plate provided with a plurality of slots and laid in the upper layer, at least one strip line formed in the intermediate layer so as to correspond to the plurality of slots, and a lower conductive plate formed in the lower layer. At least two slots correspond to the strip line, the strip line has a feed point to which a center conductor included in a high-frequency signal transmission line is connected, and a grounding point to which a grounding conductor included in the high-frequency signal transmission line is connected is formed on a second conductive surface.

27 Claims, 16 Drawing Sheets

TEM SLOT ARRAY ANTENNA

BACKGROUND OF THE INVENTION

The present invention relates to an antenna having a flat radiowave radiating surface and, more particularly, to a planar antenna suitable for use in combination particularly with a terminal apparatus included in a radio communication system.

Antennas for radio apparatuses using frequencies in a microwave frequency band or a millimeter wave frequency band are array antennas having an array construction which enhances the gain to secure a satisfactory quality of communication using radio waves of short wavelengths. The array antennas include microstrip array antennas, such as disclosed in, for example, Japanese Patent Laid-open (Kokai) Nos. Hei 1-269302 and Hei 1-292903, having a feeder line and radiation elements arranged in a plane,a triplet micro-strip antenna, such as disclosed in, for example, Japanese Patent Laid-open (Kokai) No. Hei 4-82405, having a feeder line formed in an inner layer to feed power to radiation elements formed in an outer layer, and waveguide planar antenna, such as disclosed in, for example, Japanese Patent Laid-open (Kokai) No. Hei 1-314405, having an array of a plurality of rectangular waveguides having upper walls provided with slots which serve as radiation elements to reduce loss by a feeder line, and receiving power.

If the number of the radiation elements of the prior art micro-strip array antenna is increased to enhance the antenna gain, the number of branches of the feeder line for feeding high frequency power to radiation elements increases and feeder loss attributable to multiple reflection by the branches increases. Therefore, it is difficult to enhance the antenna gain by increasing the number of the radiation elements. The prior art waveguide planar antenna needs much time and labor for fabrication, because walls of a length equal to several times the wavelength must be formed perpendicular to the surface of the planar antenna to realize an electromagnetic mode for the waveguides. Therefore, it is difficult to mass-produce the waveguide planar antenna and the waveguide planar antenna is inevitably costly despite of various proposals.

SUMMARY OF THE INVENTION

The present invention has been made in view of those problems in the prior art and it is therefore an object of the present invention to provide a novel, mass-productive planar antenna having a plurality of radiation elements to which power can be fed at a low power loss.

According to the present invention, the foregoing problems in the prior art can effectively be solved by laminating at least two dielectric substrates to form an upper layer, an intermediate layer and a lower layer, forming an upper conductive plate provided with a plurality of slots in the upper layer, forming at least one strip line corresponding to the plurality of slots in the intermediate layer, forming a lower conductive plate over the entire surface of the lower layer, connecting a center conductor of a high-frequency signal transmission line to a feed point on the strip line, and forming a grounding point to which a grounding conductor of the transmission line is connected in the lower conductive plate.

When a high-frequency signal is applied to the strip line, an electromagnetic wave of a TEM mode (transverse electromagnetic mode) propagates in the longitudinal direction of the strip line between the upper conductive plate and the lower conductive plate. Since the electromagnetic wave is formed along the strip line, the electromagnetic wave is coupled with the slots, i.e., radiation elements, and is radiated. The electromagnetic wave is coupled strongly when the length of the slots is about half the wavelength of the electromagnetic wave, and a radio wave is radiated efficiently. Since the slots arranged on the strip line are excited by the electromagnetic wave propagating along the strip line, branches are unnecessary and hence the inevitable power loss attributable to branches is not increased.

Since the electromagnetic wave is confined in the strip line during propagation, leakage of the electromagnetic wave through side surfaces including the open ends of the upper conductive plate and the lower conductive plate is small when the respective widths of the upper conductive plate and the lower conductive plate are great as compared with the width of the strip line. Therefore, the side surfaces may be left open. Accordingly, ordinary multilayer substrate forming techniques can be employed and the antenna can be manufactured at a low manufacturing cost.

However, it is desirable to suppress the leakage of the electromagnetic wave by surrounding the side surfaces by a conductor, i.e., by forming a structure perpendicular to the upper conductive plate, when the side surfaces are close to the strip line. In this case, the conductors on the upper layer, the lower layer and the side surfaces form a conducting box. Any vertical structure need not be formed between the strip lines, and vertical structures are formed only on the side surfaces. Since the side surfaces can be formed by, for example, forming through holes, ordinary multilayer substrate forming techniques can be used.

If the antenna is provided with two or more strip lines, a feed point can be formed on each strip line, and a feed point may be formed at a point on a dividing strip conductor connected to one end of each strip line.

These and other objects and many of the attendant advantages of the invention will be readily appreciated as the same becomes better understood by reference to the following detailed description when considered in connection with the accompanying drawings.

DETAILED DESCRIPTION OF THE PREFERRED EMBODIMENTS

Figure 1A:
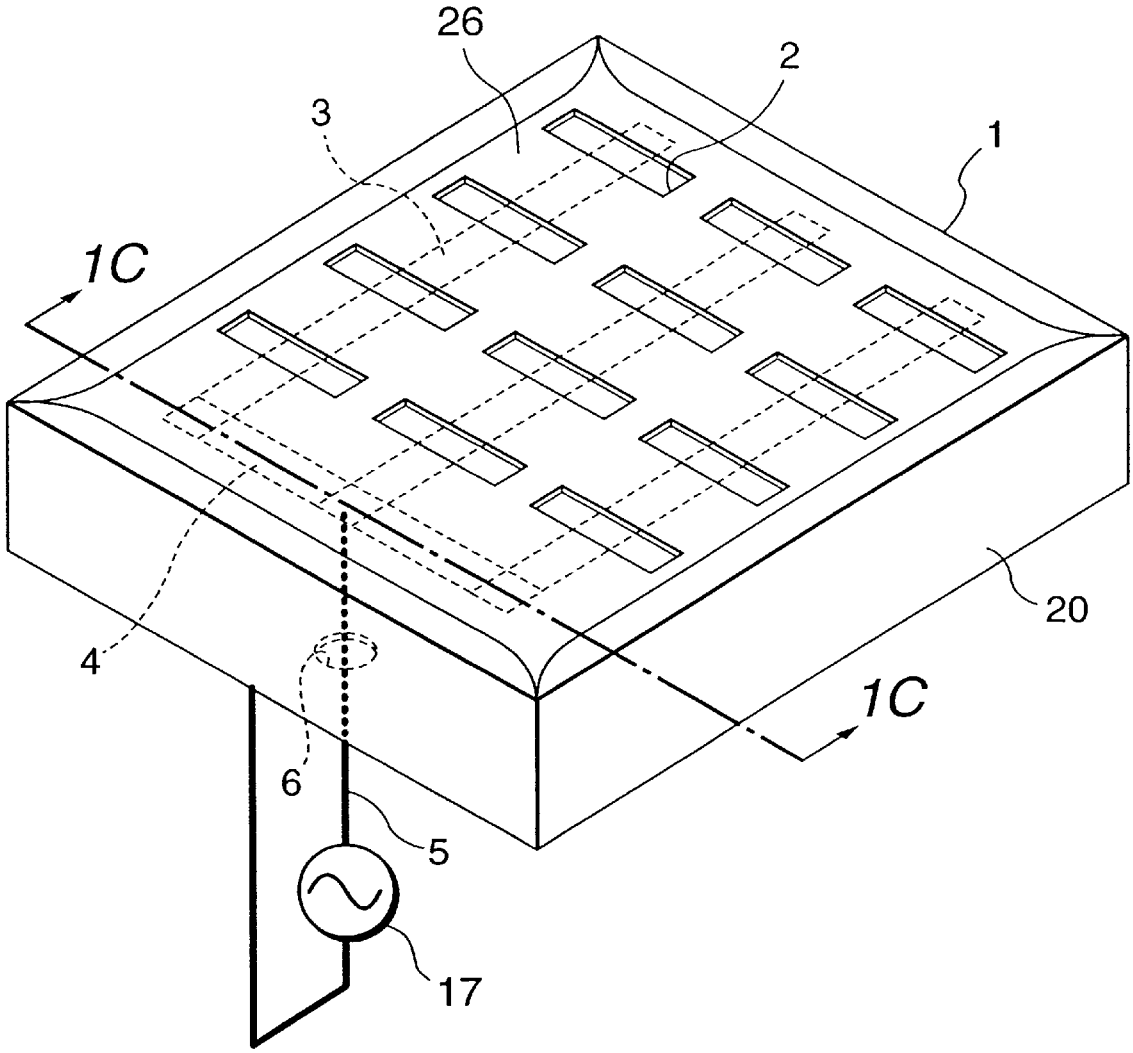
FIG. 1A is a schematic perspective view of a TEM slot antenna in a first embodiment according to the present invention.

TEM slot array antennas in preferred embodiments according to the present invention will be described hereinafter with reference to the accompanying drawings, in which like or corresponding parts are designated by the same reference character.

FIRST EMBODIMENT

Figure 1B:
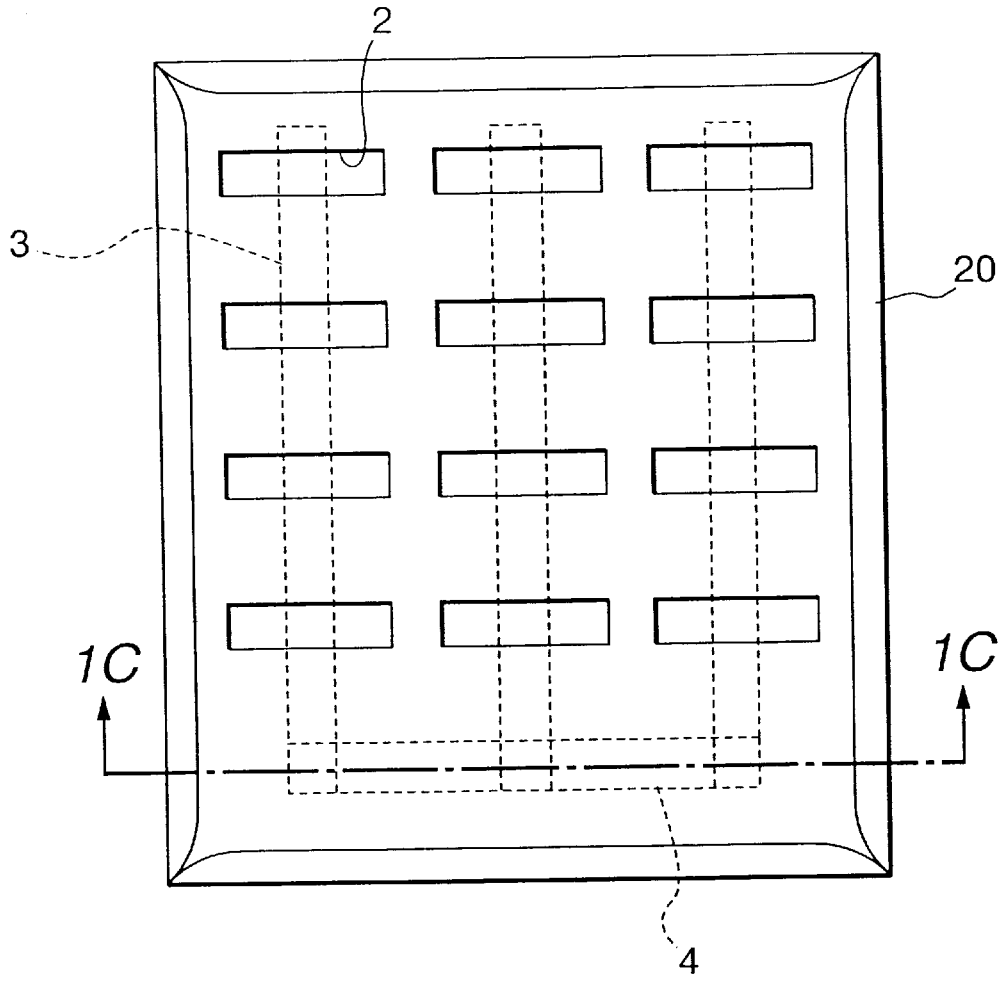
FIG. 1B is a plan view of the TEM slot antenna of FIG. 1A.
Figure 1C:
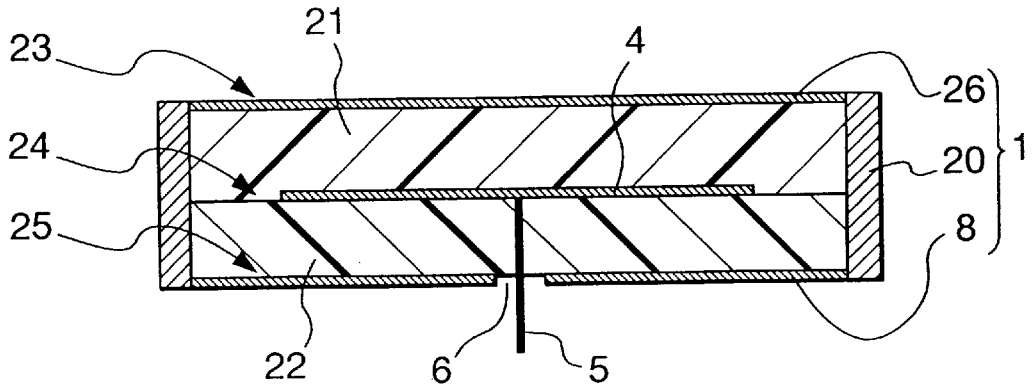
FIG. 1C is a sectional view taken on line 1C—1C in FIGS. 1A and 1B.

A TEM slot array antenna in a first embodiment according to the present invention will be described with reference to FIGS. 1A, 1B and 1C. FIGS. 1A and 1B are a schematic perspective view and a plan view of the TEM slot array antenna, respectively. FIG. 1C is a sectional view taken on line 1C—lC in FIGS. 1A and 1B. Shown in FIGS. 1B and 1C are dielectric substrates 21 and 22, a first layer (upper layer) 23, a second layer (intermediate layer) 24, a third layer (lower layer) 25, slots 2 formed in the first layer 23, a upper conductive plate 26 disposed in the first layer 23, three strip lines 3 formed in the second layer 24, a dividing strip conductor 4 connected to one end of each strip line 3, a lower conductive plate 8 formed in the third layer 25, and through holes 20 of the shape of a flat plate formed across the upper conductive plate 26 and the lower conductive plate 8.

Each strip line 3 corresponds to the four slots 2, and the TEM slot array antenna has three slot rows each of the four slots 2. The through holes 20 are arranged in a rectangular arrangement so as to surround the slots 2, the strip lines 3 and the dividing strip conductor 4. The through holes 20 are not electrically connected to the strip lines 3 and the dividing strip conductor 4, and define the side surfaces of the TEM slot array antenna.

The slots 2 are formed in the same dimensions and have an elongate, rectangular shape. The slots 2 of each slot row are arranged at equal intervals with their longitudinal axes extended perpendicular to the longitudinal axis of the corresponding strip line 3. Each of the slots 2 is disposed so that the distance between the center of the slot 2 and the longitudinal axis of the corresponding strip line 3 is a minimum.

As shown in FIG. 1A in a schematic perspective view, a feeder line 5 is connected to a feed point at the middle of the dividing strip conductor 4. The upper conductive plate 26, the lower conductive plate 8 and the through holes 20 form a rectangular conducting box 1.

The feeder line 5 is extended outside through a coupling hole 6 formed in the lower conductive plate 8 and no portion of the feeder line 5 is in electrical contact with the conducting box 1. A high-frequency circuit 17 is connected to the feeder line 5 and a point on the surface of the conducting box 1 to feed high-frequency power to the TEM slot array antenna. The high-frequency power supplied through the feeder line 5 to the TEM slot array antenna is distributed through the dividing strip conductor 4 to the three strip lines 3, the high-frequency power distributed to the strip lines 3 is coupled with the slots 2 at positions directly below the slots 2 for radiation.

The TEM slot array antenna is fabricated by ordinary multilayer substrate forming techniques. The upper conductive plate 26 provided with the slots 2 is attached to the upper surface of the dielectric substrate 21, the strip lines 3 and the dividing strip conductor 4 are formed on the upper surface of the dielectric substrate 21, the lower conductive plate 8 is formed on the lower surface of the dielectric substrate 21, the dielectric substrates 21 and 22 are joined together, and then the through holes 20 are formed.

A protective layer is formed on the first layer 23 to ensure the stability of the TEM slot array antenna for a long period of time. Preferably, the protective layer is of a multilayer construction having a high transmissivity to electromagnetic waves.

Although the TEM slot array antenna has the three strip lines and the four slots on each slot row corresponding to each strip line, the number of the strip lines and that of the slots on each slot row are not limited thereto, but the TEM slot array antenna may have any suitable number strip lines and any suitable number of slots on each slot row.

The following description of the preferred embodiments of the present invention will be made in connection with schematic perspective views similar to FIG. 1A showing the box 1 formed by laminating the substrates and having through holes forming side surfaces, and sectional views of TEM slot array antennas shown in the schematic perspective views to simplify illustration and to avoid duplication.

SECOND EMBODIMENT

Figure 2A:
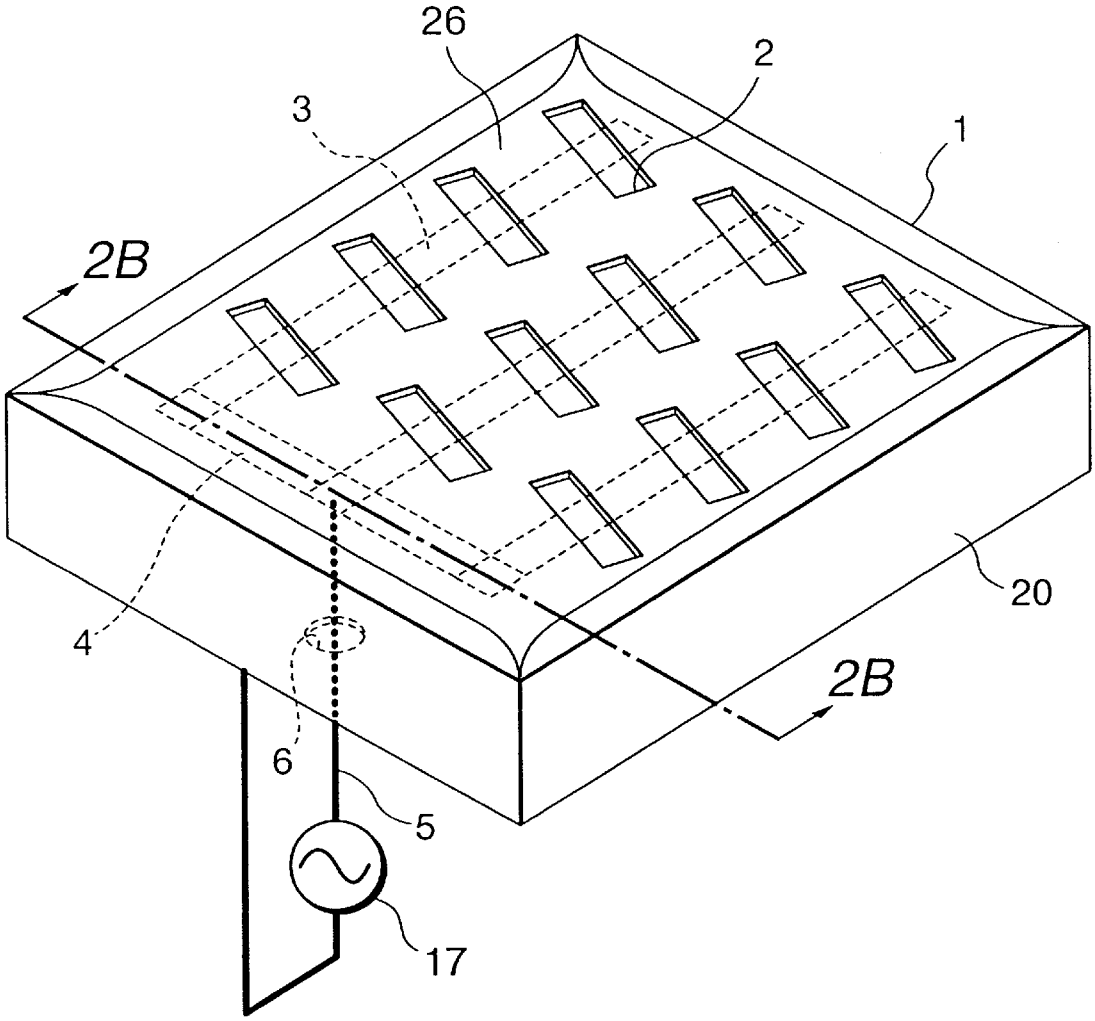
FIG. 2A is a schematic perspective view of a TEM slot antenna in a second embodiment according to the present invention.
Figure 2B:
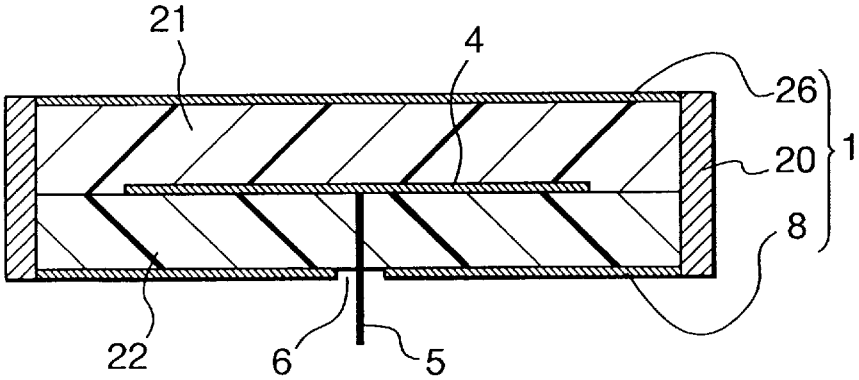
FIG. 2B is a sectional view taken on line 2B—2B in FIG. 2A.

A TEM slot array antenna in a second embodiment according to the present invention will be described with reference to FIGS. 2A and 2B. FIG. 2A is a schematic perspective view of the TEM slot array antenna and FIG. 2B is a sectional view taken on line 2B—2B in FIG. 2A. The second embodiment is similar to the first embodiment, but differs from the first embodiment in that slots 2 formed so that their longitudinal axes are inclined at an angle other than a right angle to the longitudinal axes of corresponding strip lines 3. Since the polarizing direction of an electromagnetic wave radiated by this TEM slot array antenna can be inclined to the long sides of a conductive box 1, the degree of freedom of design for the adjustment of the polarizing direction of the TEM slot array antenna is increased.

THIRD EMBODIMENT

Figure 3A:
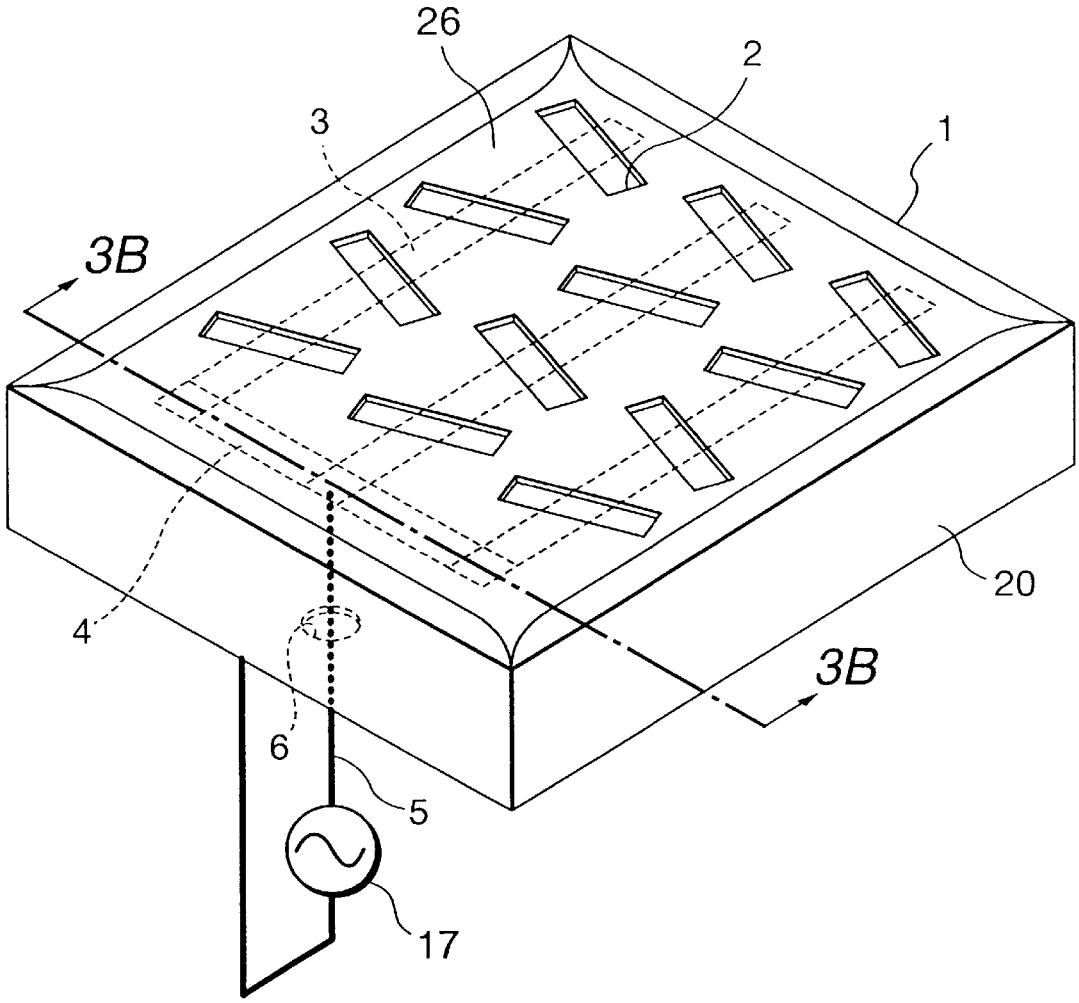
FIG. 3A is a schematic perspective view of a TEM slot antenna in a third embodiment according to the present invention.
Figure 3B:
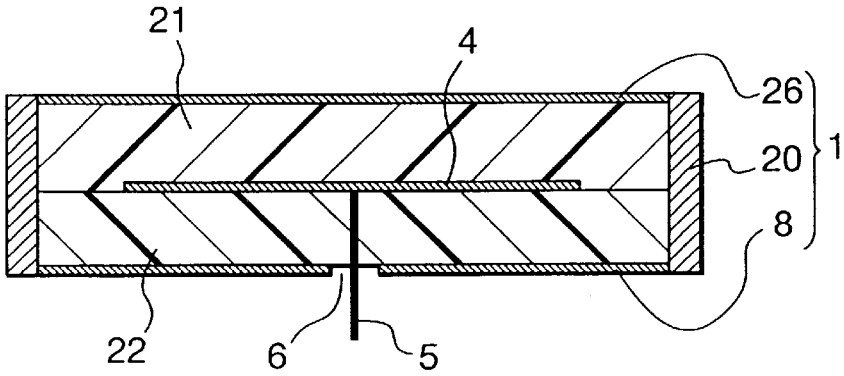
FIG. 3B is a sectional view taken on line 3B—3B in FIG. 3A.

A TEM slot array antenna in a third embodiment according to the present invention will be described with reference to FIGS. 3A and 3B. FIG. 3A is a schematic perspective view of the TEM slot array antenna and FIG. 3B is a sectional view taken on line 3B—3B in FIG. 3A. The third embodiment is similar to the first embodiment, but differs from the first embodiment in that the respective longitudinal axes of two adjacent slots 2 on each of a plurality of slot rows intersect each other at right angles, and the distance between points on the two adjacent slot 2 corresponding to a strip line 3 is ¼ of the operating wavelength of the TEM slot array antenna. The TEM slot array antenna in the third embodiment is capable of radiating a circular polarization wave and can be used in an expanded range of application.

FOURTH EMBODIMENT

Figure 4A:
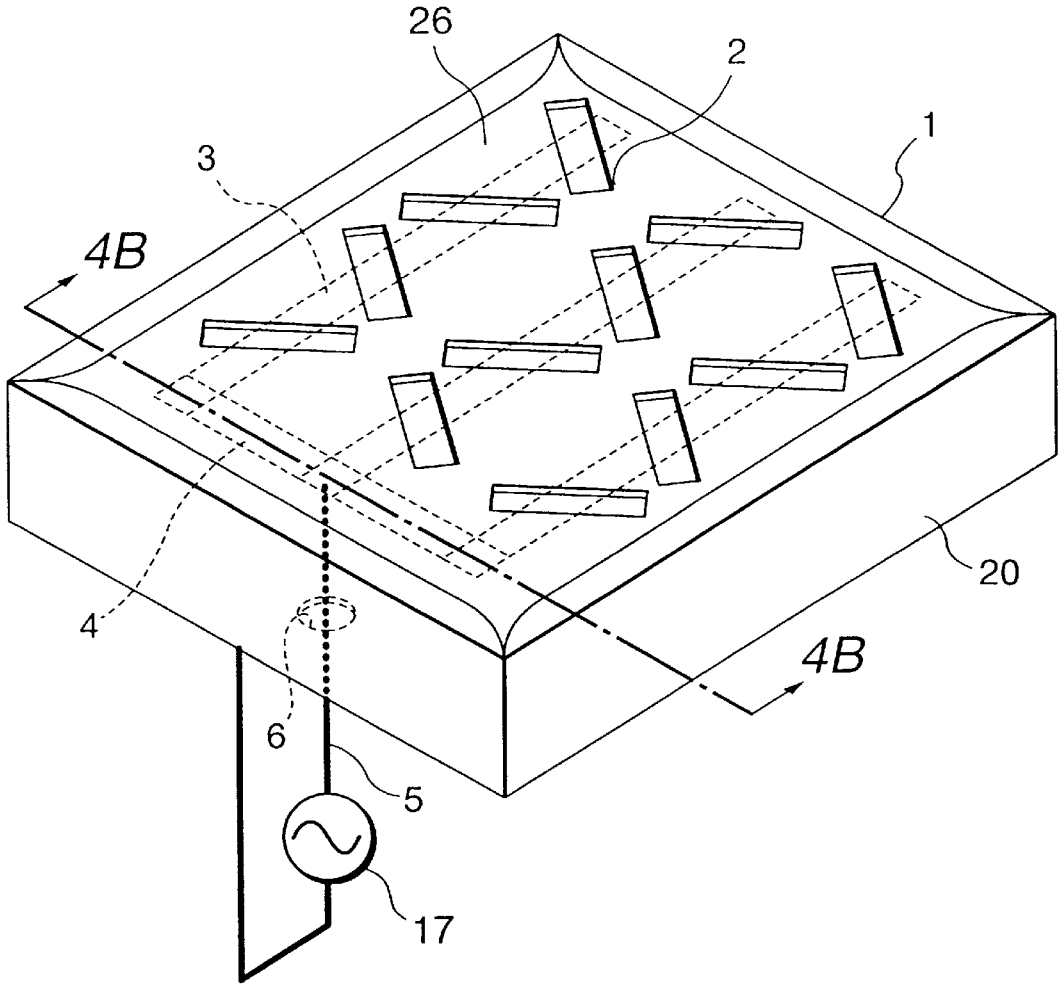
FIG. 4A is a schematic perspective view of a TEM slot antenna in a fourth embodiment according to the present invention.
Figure 4B:
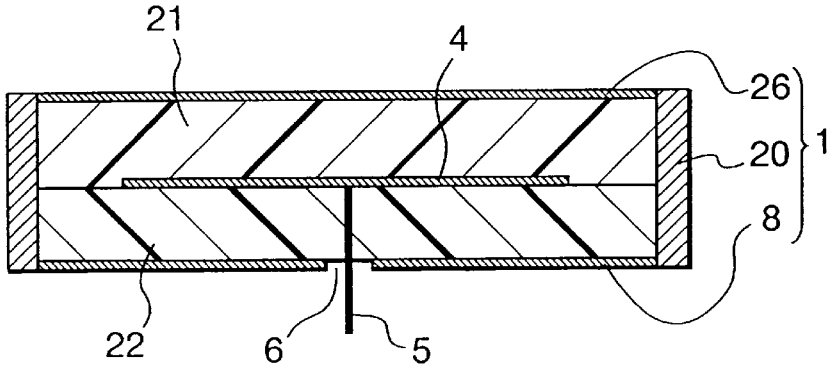
FIG. 4B is a sectional view taken on line 4B—4B in FIG. 4A.

A TEM slot array antenna in a fourth embodiment according to the present invention will be described with reference to FIGS. 4A and 4B. FIG. 4A is a schematic perspective view of the TEM slot array antenna and FIG. 4B is a sectional view taken on line 4B—4B in FIG. 4A. The fourth embodiment is similar to the third embodiment, but differs from the third embodiment in that the respective longitudinal axes of two adjacent slots 3 on each of a plurality of slot rows intersect each other at right angles, and the respective longitudinal axes of the corresponding slots 3 on the two adjacent slot rows are inclined at equal angles to the corresponding slot row in opposite directions, respectively. This TEM slot array antenna is capable of simultaneously receiving a right-hand circular polarization wave and a left-hand circular polarization wave, and can be used in an expanded range of application.

FIFTH EMBODIMENT

Figure 5A:
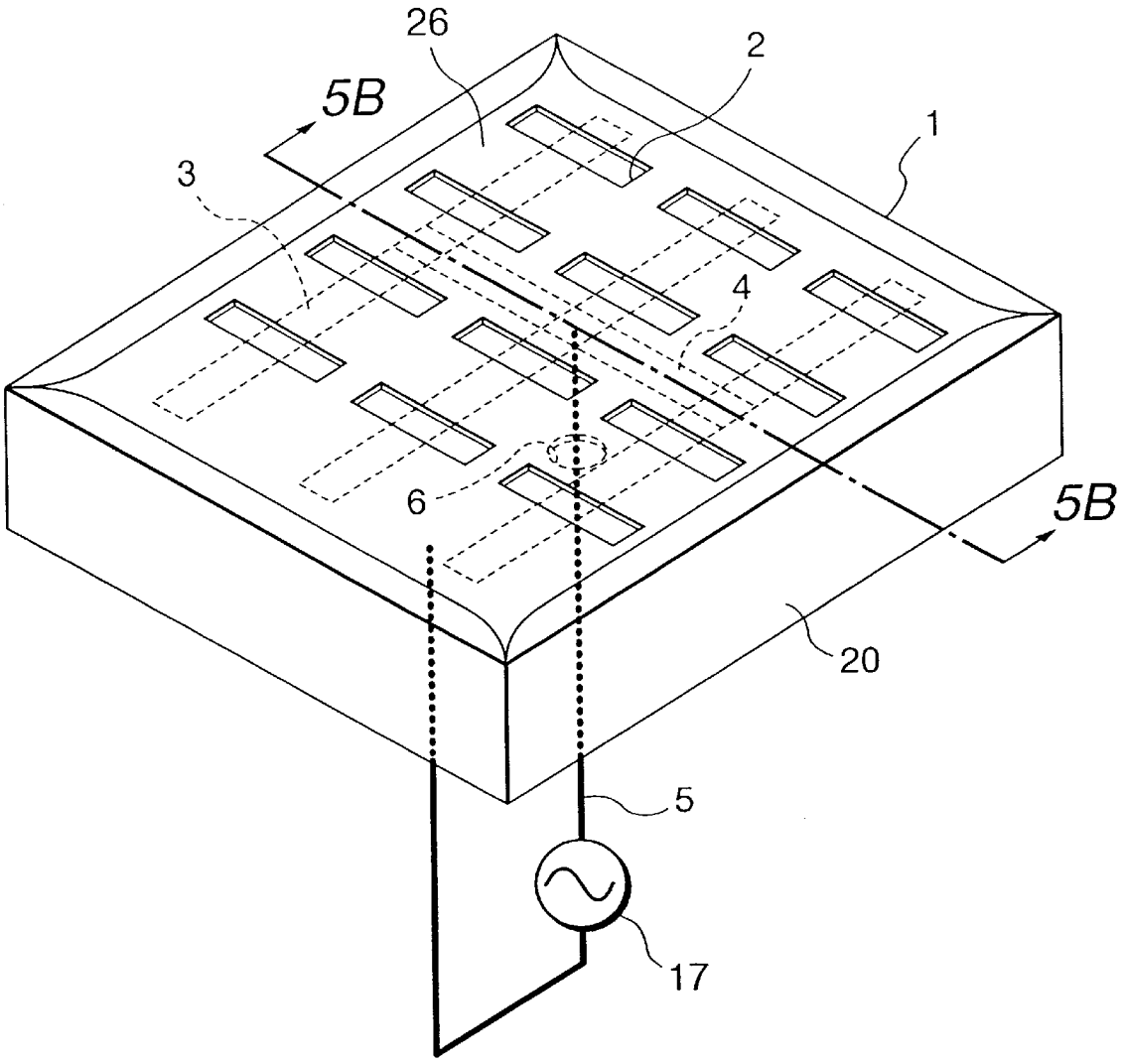
FIG. 5A is a schematic perspective view of a TEM slot antenna in a fifth embodiment according to the present invention.
Figure 5B:
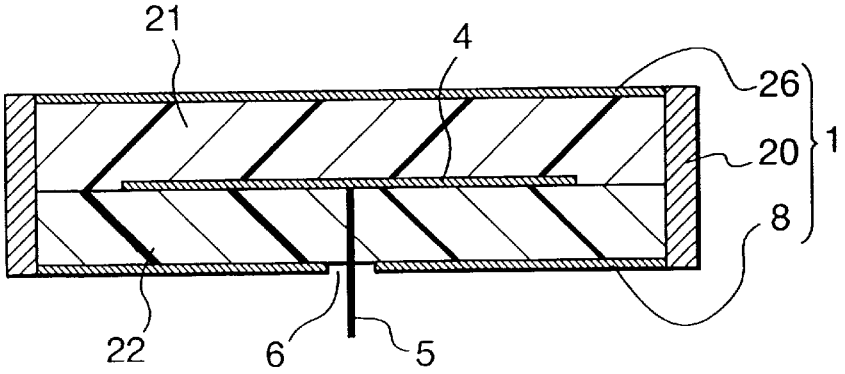
FIG. 5B is a sectional view taken on line 5B—5B in FIG. 5A.

A TEM slot array antenna in a fifth embodiment according to the present invention will be described with reference to FIGS. 5A and 5B. FIG. 5A is a schematic perspective view of the TEM slot array antenna and FIG. 5B is a sectional view taken on line 5B—5B in FIG. 5A. The fifth embodiment is similar to the first embodiment, but differs from the first embodiment in that a dividing strip conductor 4 is electrically connected to the middles of three strip lines 3. Since the number of combinations of slots 2 which are equal in the distance between the center of the slot 2 formed on a conducting box 1 and the joint of a feeder line 5 and the dividing strip conductor 4 is increased, an electromagnetic wave can easily uniformly be distributed on the surface in which the slots 2 are formed. Since the higher the uniformity of distributed electromagnetic wave on the surface in which the slots are formed, the higher is the efficiency of the TEM slot array antenna, time and labor necessary for designing a high-efficiency antenna can be reduced.

SIXTH EMBODIMENT

Figure 6A:
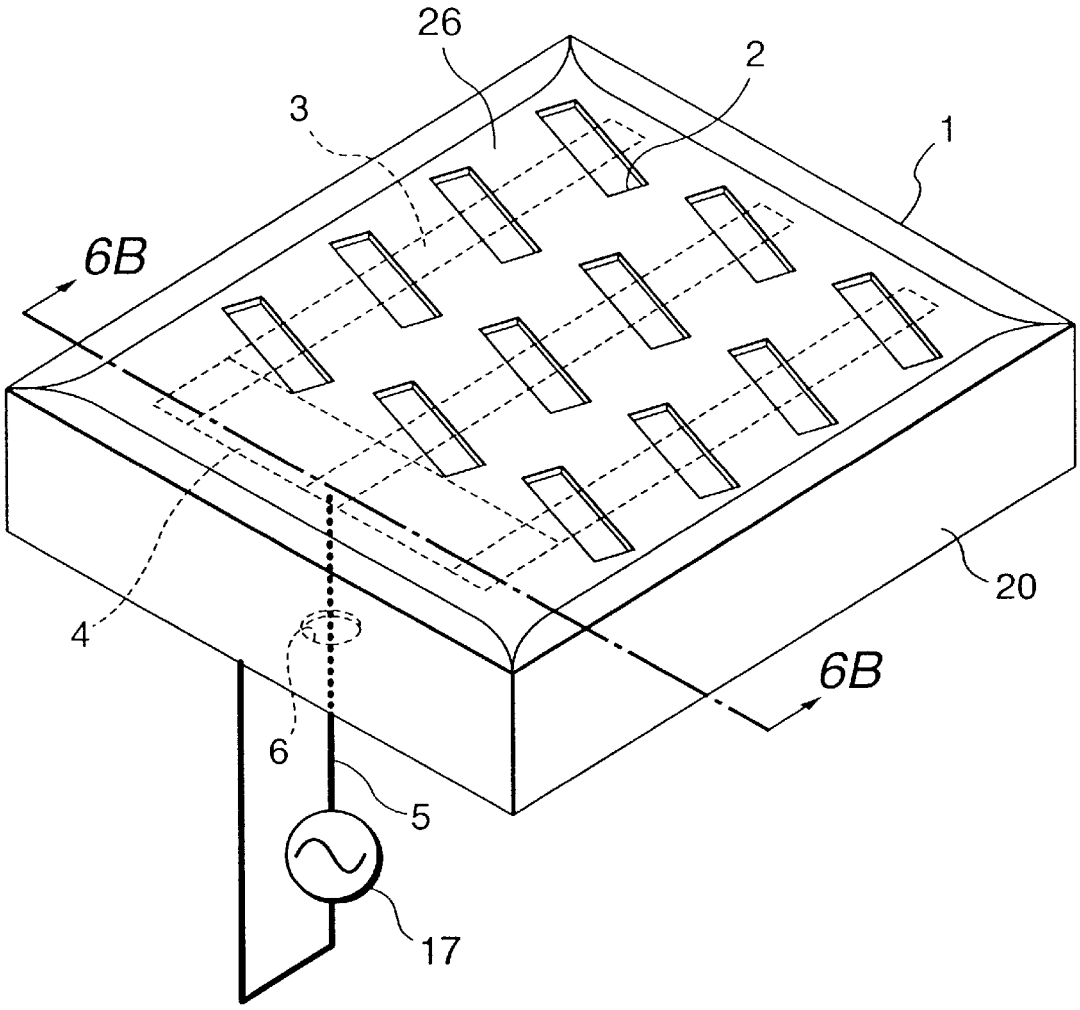
FIG. 6A is a schematic perspective view of a TEM slot antenna in a sixth embodiment according to the present invention.
Figure 6B:
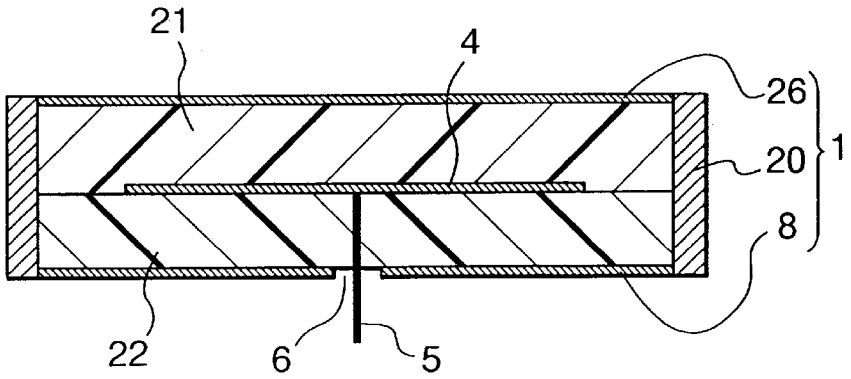
FIG. 6B is a sectional view taken on line 6B—6B in FIG. 6A.

A TEM slot array antenna in a sixth embodiment according to the present invention will be described with reference to FIGS. 6A and 6B. FIG. 6A is a schematic perspective view of the TEM slot array antenna and FIG. 6B is a sectional view taken on line 6B—6B in FIG. 6A. The sixth embodiment is similar to the second embodiment, but differs from the second embodiment in that the width of a dividing strip conductor 4 is greater than that of three strip lines 3. A strip conductor formed in a conducting box 1 and having a greater width has a smaller impedance. Since the plurality of strip lines 3 are connected in parallel to the dividing strip conductor 4, impedance matching at the joint is improved by reducing the impedance of the dividing strip conductor 4 below that of the strip lines 3, whereby the efficiency of transmission of high-frequency power from a feeder line to the slots and the efficiency of the TEM slot array antenna are improved.

SEVENTH EMBODIMENT

Figure 7A:
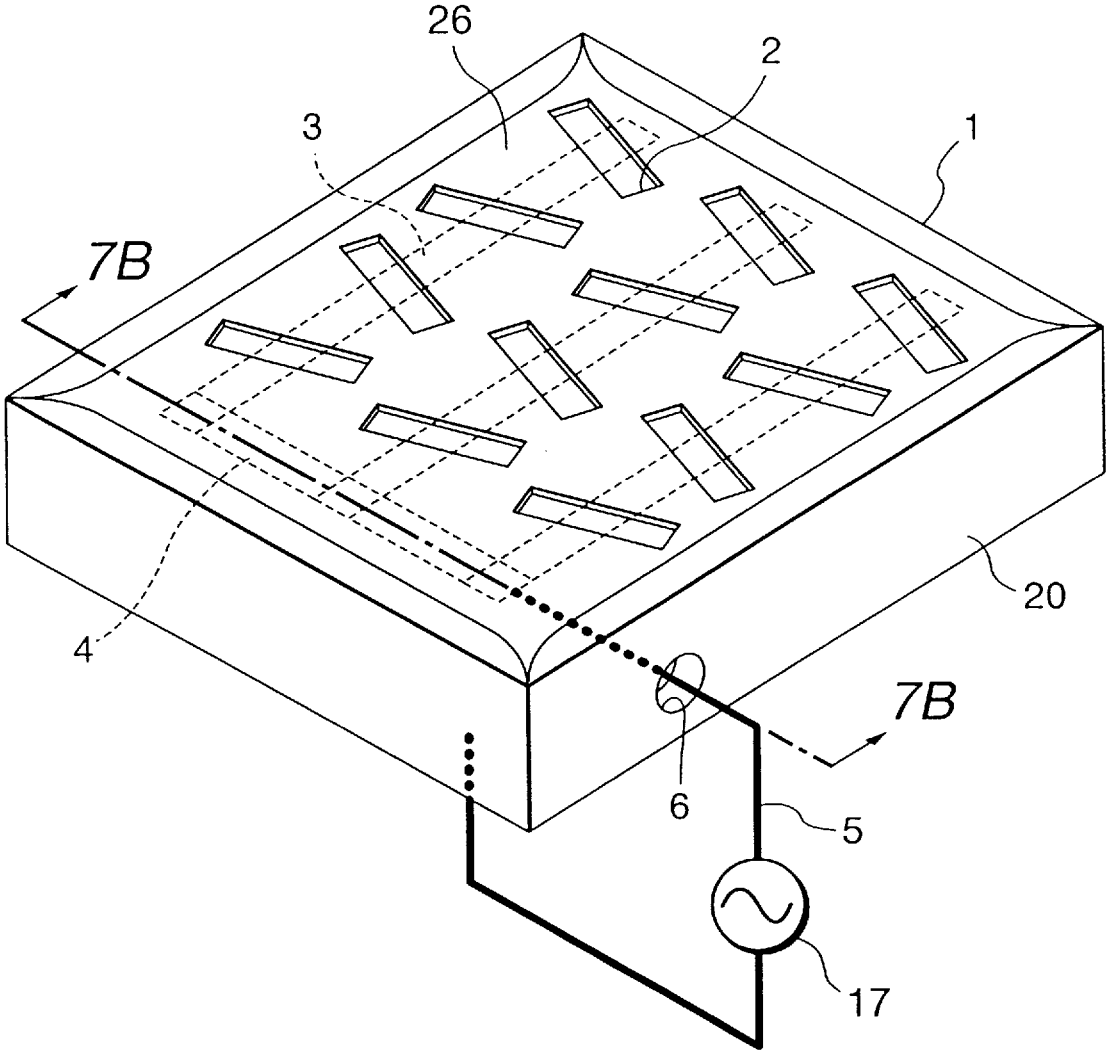
FIG. 7A is a schematic perspective view of a TEM slot antenna in a seventh embodiment according to the present invention.
Figure 7B:
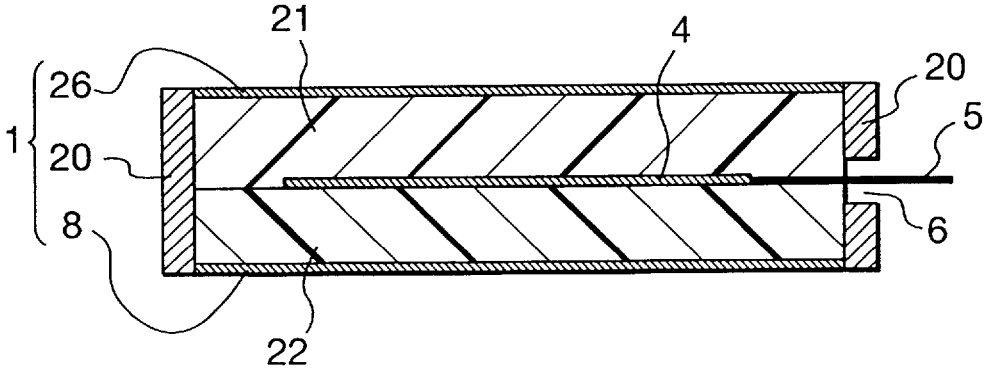
FIG. 7B is a sectional view taken on line 7B—7B in FIG. 7A.

A TEM slot array antenna in a seventh embodiment according to the present invention will be described with reference to FIGS. 7A and 7B. FIG. 7A is a schematic perspective view of the TEM slot array antenna and FIG. 7B is a sectional view taken on line 7B—7B in FIG. 7A. The seventh embodiment is similar to the third embodiment, but differs from the third embodiment in that a coupling hole 6 is formed in a side surface of a conducting box 1, and a feeder line 5 is extended in a plane including strip lines 3 and a dividing strip conductor 4 and connected to one end of the dividing strip conductor 4. Since a high-frequency circuit 17 for generating high-frequency power to be applied to the TEM slot array antenna can be formed near the side surface of the TEM slot array antenna, the TEM slot array antenna and the high-frequency circuit 17 can be combined in a thin unit.

EIGHTH EMBODIMENT

Figure 8A:
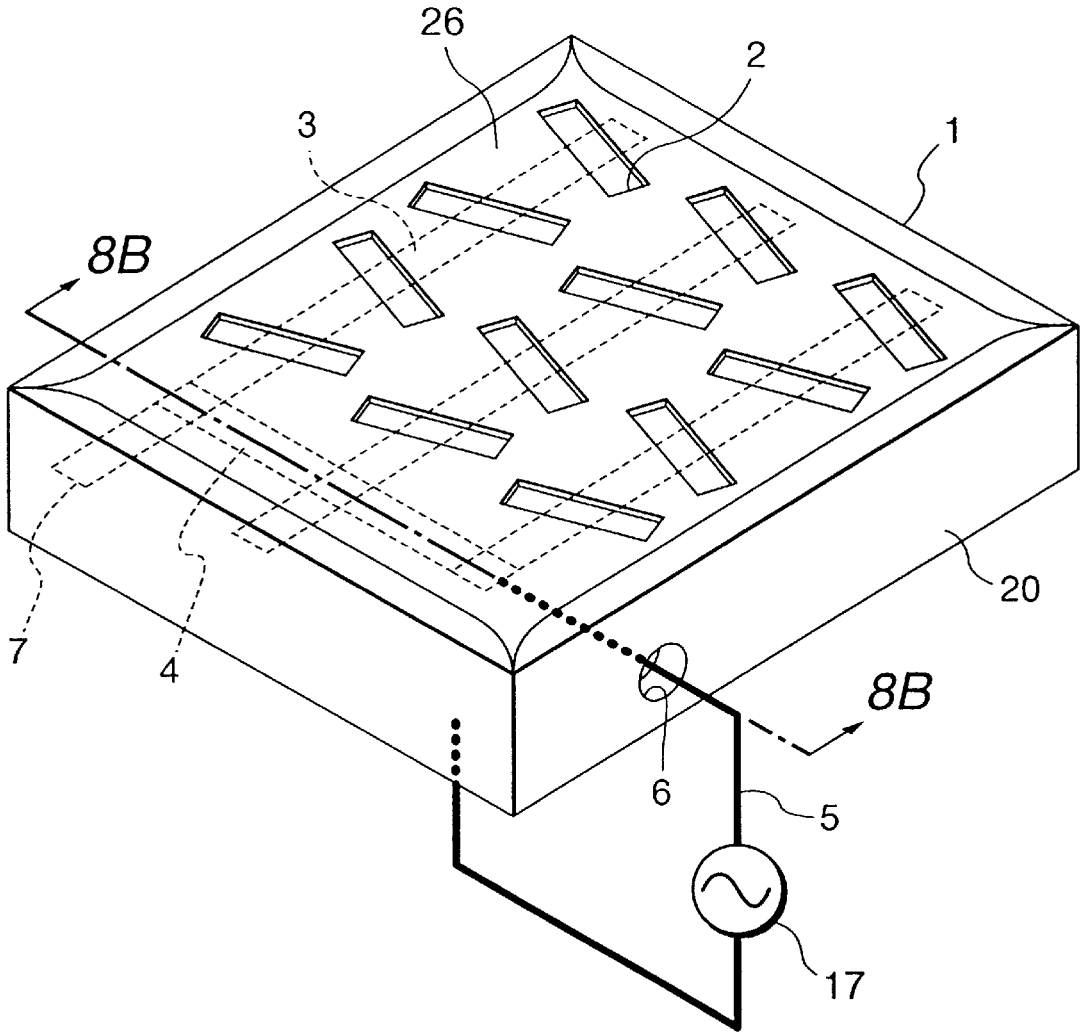
FIG. 8A is a schematic perspective view of a TEM slot antenna in a eighth embodiment according to the present invention.
Figure 8B:
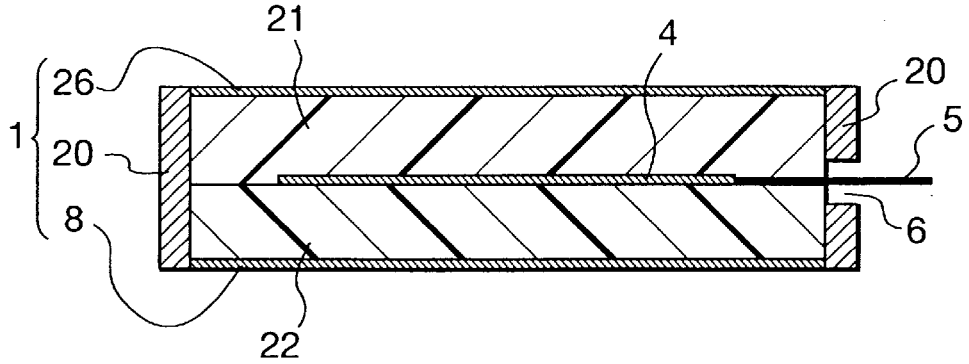
FIG. 8B is a sectional view taken on line 8B—8B in FIG. 8A.

A TEM slot array antenna in an eighth embodiment according to the present invention will be described with reference to FIGS. 8A and 8B. FIG. 8A is a schematic perspective view of the TEM slot array antenna and FIG. 8B is a sectional view taken on line 8B—8B in FIG. 8A. The eighth embodiment is similar to the seventh embodiment, but differs from the seventh embodiment in that stub strip lines 7 are connected to a dividing strip conductor 4 at the joints of the dividing strip conductor 4 and strip lines 3. The stub strip lines 7 extend in a direction opposite a direction in which the strip lines 3 extend from the dividing strip conductor 4. Since impedance mismatching at the joints of the strip lines 3 and the dividing strip conductor 4 can be corrected, the efficiency of transmission of high-frequency power from a feeder line to slots can be improved and the efficiency of the TEM slot array antenna can be improved accordingly.

NINTH EMBODIMENT

Figure 9A:
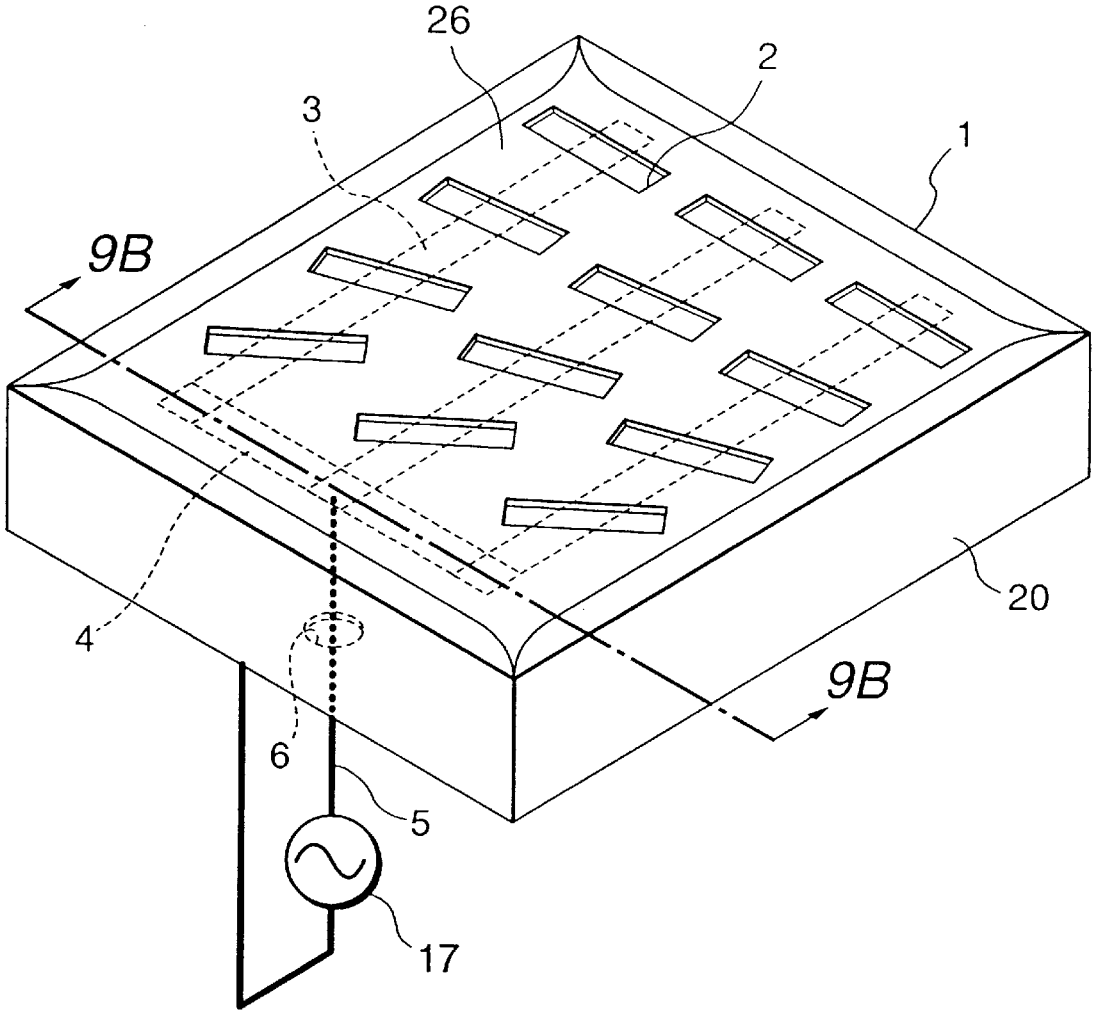
FIG. 9A is a schematic perspective view of a TEM slot antenna in a ninth embodiment according to the present invention.
Figure 9B:
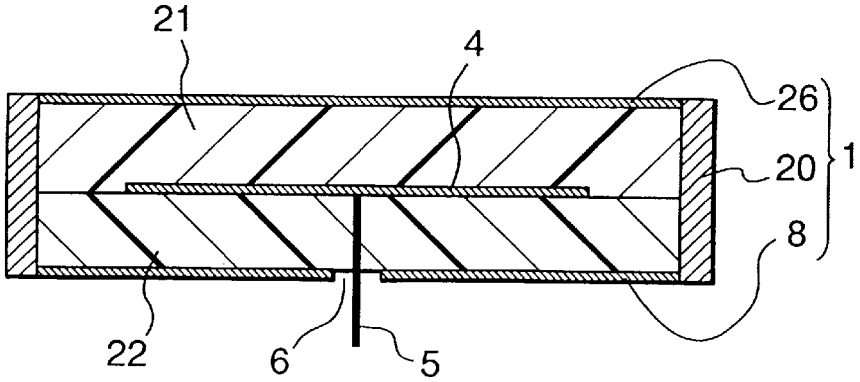
FIG. 9B is a sectional view taken on line 9B—9B in FIG. 9A.

A TEM slot array antenna in a ninth embodiment according to the present invention will be described with reference to FIGS. 9A and 9B. FIG. 9A is a schematic perspective view of the TEM slot array antenna and FIG. 9B is a sectional view taken on line 9B—9B in FIG. 9A. The ninth embodiment is similar to the first embodiment, but differs from the first embodiment in that an angle between the longitudinal axis of a strip line 3 and the longitudinal axis of a slot 2 nearer to a feed point among a plurality of slots 2 on a slot row is smaller than that between the longitudinal axis of the strip line 3 and the longitudinal axis of a slot 2 farther from the feed point among the slots 2 on the same slot row. The strength of electromagnetic coupling of the slot 2 and the strip line 3 increases as the angle between the respective longitudinal axes of the slot 2 and the strip line 3 approaches 90°. Therefore, the strength of electromagnetic coupling of the slot 2 nearer to a dividing strip conductor 4 and the strip line 3 is lower than that of the slot 2 farther from the dividing strip conductor 4 and the strip line 3. On the other hand, the magnitude of high-frequency power transmitted to a position directly below the slot 2 decreases with distance from the dividing strip conductor 4. Therefore, the uniformity of the disributed electromagnetic wave on the surface in which the slots 2 are formed is improved by the interpolation effects of those facts, so that the efficiency of the TEM slot array antenna is improved.

TENTH EMBODIMENT

Figure 10A:
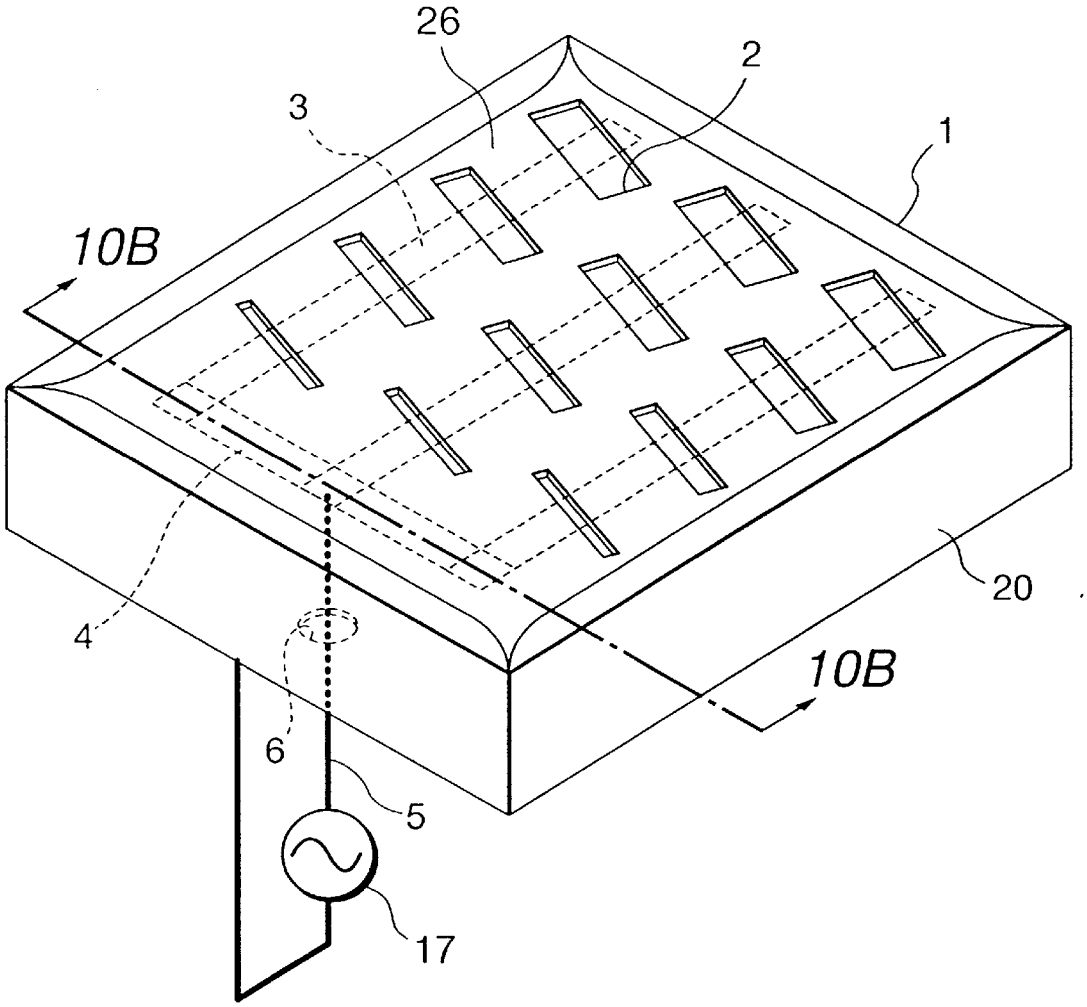
FIG. 10A is a schematic perspective view of a TEM slot antenna in a tenth embodiment according to the present invention.
Figure 10B:
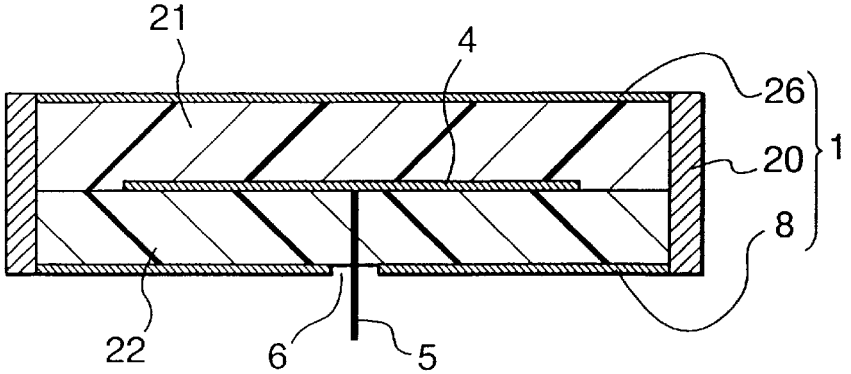
FIG. 10B is a sectional view taken on line 10B—10B in FIG. 10A.

A TEM slot array antenna in a tenth embodiment according to the present invention will be described with reference to FIGS. 10A and 10B. FIG. 10A is a schematic perspective view of the TEM slot array antenna and FIG. 10B is a sectional view taken on line 10B—10B in FIG. 10A. The tenth embodiment is similar to the second embodiment, but differs from the second embodiment in that the width of a slot 2 (dimension in a direction perpendicular to the longitudinal axis of the slot 2) nearer to a feed point on a corresponding strip line 3 among a plurality of slots 2 on each slot row is smaller than that of the slot 2 farther from the feed point among the plurality of slots on the same slot row. The strength of electromagnetic coupling of the slot 2 and the strip line 3 increases with the width of the slot 2. Accordingly, the strength of electromagnetic coupling of the slot 2 nearer to a dividing strip conductor 4 is lower. On the other hand, the magnitude of high-frequency power transmitted to a position directly below the slot 2 decreases with distance from the dividing strip conductor 4. Therefore, the uniformity of the disributed electromagnetic wave on the surface in which the slots 2 are formed is improved by the interpolation effects of those facts, so that the efficiency of the TEM slot array antenna is improved.

ELEVENTH EMBODIMENT

Figure 11A:
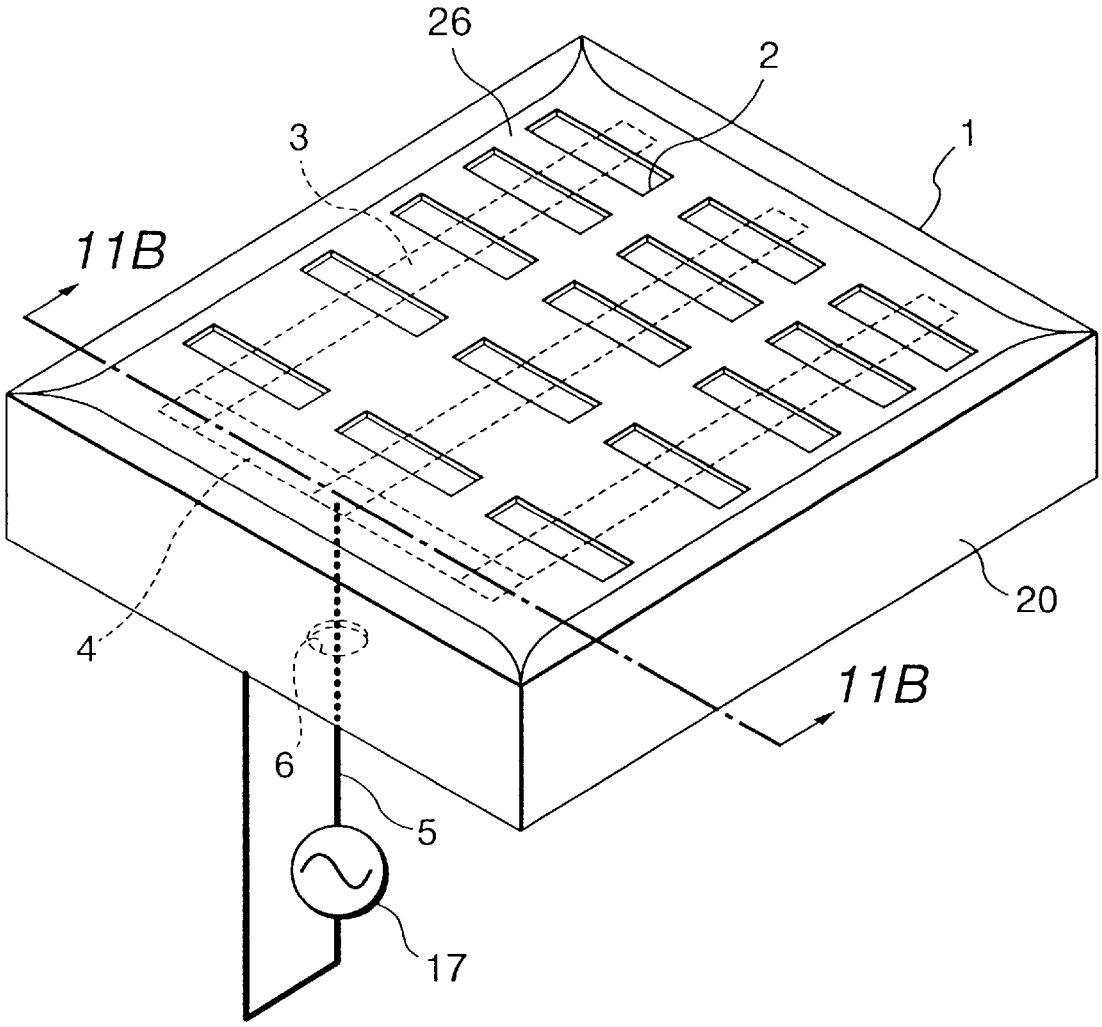
FIG. 11A is a schematic perspective view of a TEM slot antenna in an eleventh embodiment according to the present invention.
Figure 11B:
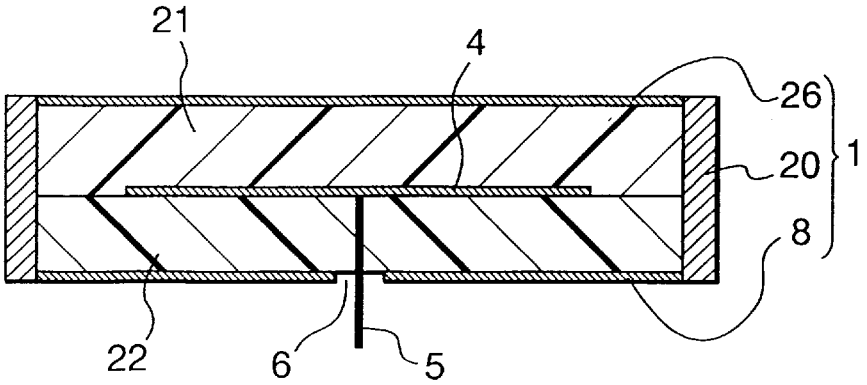
FIG. 11B is a sectional view taken on line 11B—11B in FIG. 11A.

A TEM slot array antenna in an eleventh embodiment according to the present invention will be described with reference to FIGS. 11A and 11B. FIG. 11A is a schematic perspective view of the TEM slot array antenna and FIG. 11B is a sectional view taken on line 11B—11B in FIG. 11A. The eleventh embodiment is similar to the first embodiment, but differs from the first embodiment in that the interval between two adjacent slots 2 nearer to a feed point among a plurality of slots 2 on each slot row corresponding to a strip line 3 is greater than that between the two adjacent slots 2 farther from the feed point. The magnitude of high-frequency power transmitted to a position directly below the slot 2 decreases with distance from the dividing strip conductor 4. Therefore, the uniformity of the disributed electromagnetic wave on the surface in which the slots 2 are formed is improved if the density of the slots 2 on a rectangular conducting box 1 is increased with distance from the dividing strip conductor 4 through interpolation, so that the efficiency of the TEM slot array antenna is improved.

TWELFTH EMBODIMENT

Figure 12A:
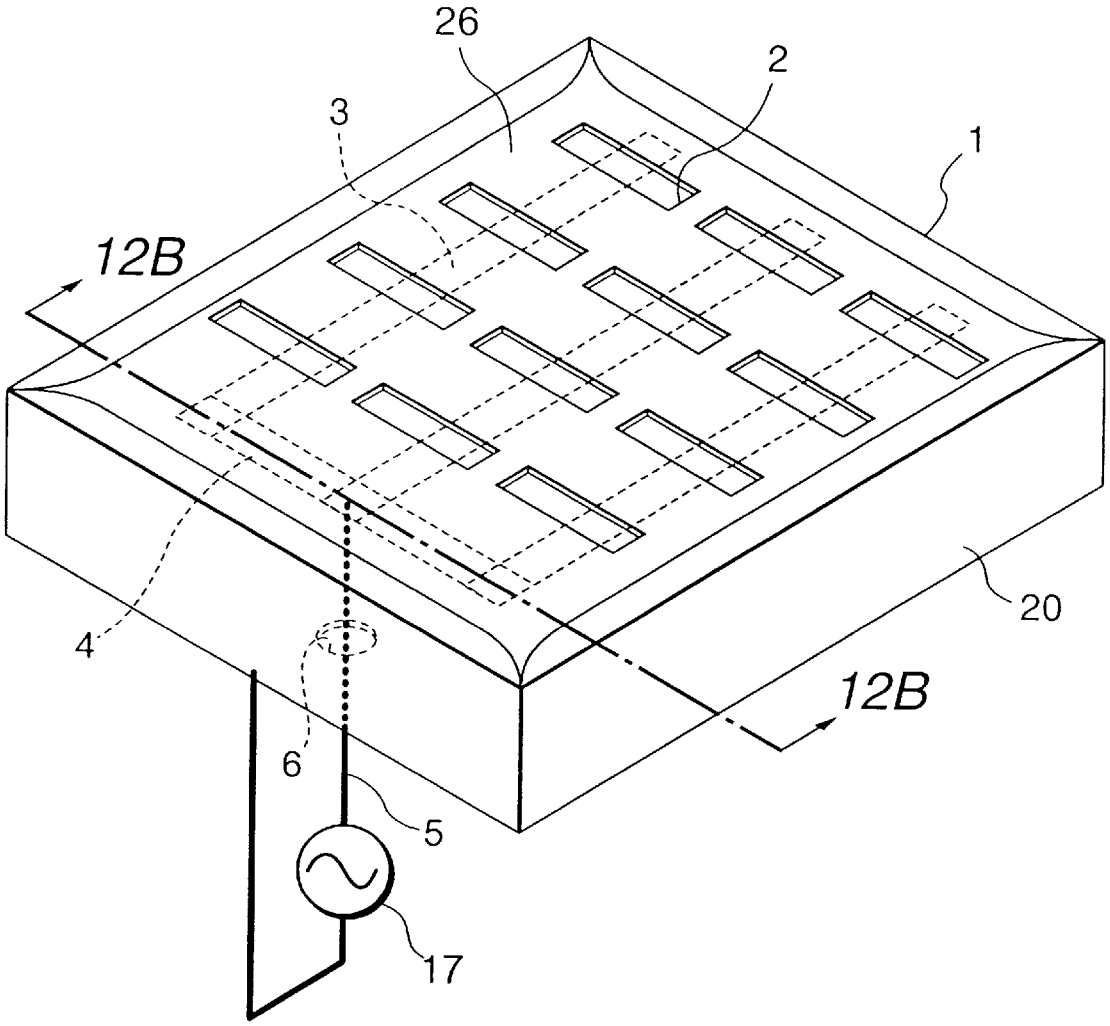
FIG. 12A is a schematic perspective view of a TEM slot antenna in a twelfth embodiment according to the present invention.
Figure 12B:
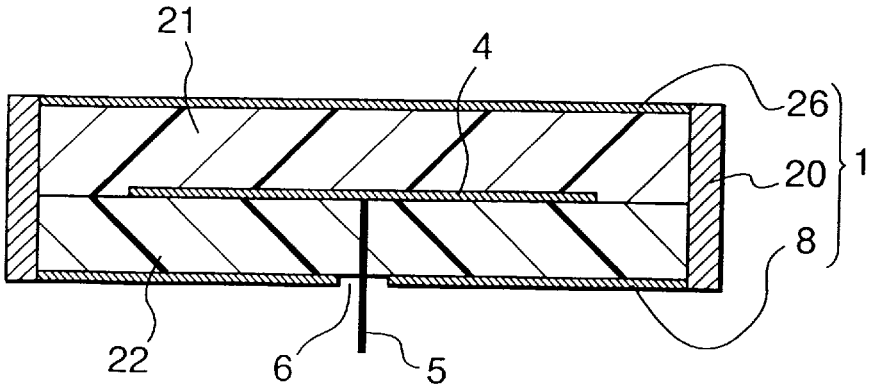
FIG. 12B is a sectional view taken on line 12B—12B in FIG. 12A.

A TEM slot array antenna in a twelfth embodiment according to the present invention will be described with reference to FIGS. 12A and 12B. FIG. 12A is a schematic perspective view of the TEM slot array antenna and FIG. 12B is a sectional view taken on line 12B—12B in FIG. 12A. The twelfth embodiment is similar to the second embodiment, but differs from the second embodiment in that the distance between the center of a slot 2 nearer to a feed point among a plurality of slots 2 on a slot row and a strip line 3 corresponding to the slot row is greater than that between the center of a slot 2 farther from the feed point and the strip line 3. The strength of electromagnetic coupling of the slot 2 and the strip line 3 decreases with the distance of the center of the slot 2 from the strip line 3, because a magnetic current which is induced in the slot 2 assumes half a sinusoidal wave. Therefore, the strength of electromagnetic coupling of the slot nearer to a dividing strip conductor 4 is lower than that of the slot farther from the dividing strip conductor 4. On the other hand, the magnitude of high-frequency power transmitted to a position directly below the slot 2 decreases with distance from the dividing strip conductor 4. Therefore, the uniformity of the disributed electromagnetic wave on the surface in which the slots 2 are formed is improved through interpolation, so that the efficiency of the TEM slot array antenna is improved.

THIRTEENTH EMBODIMENT

Figure 13A:
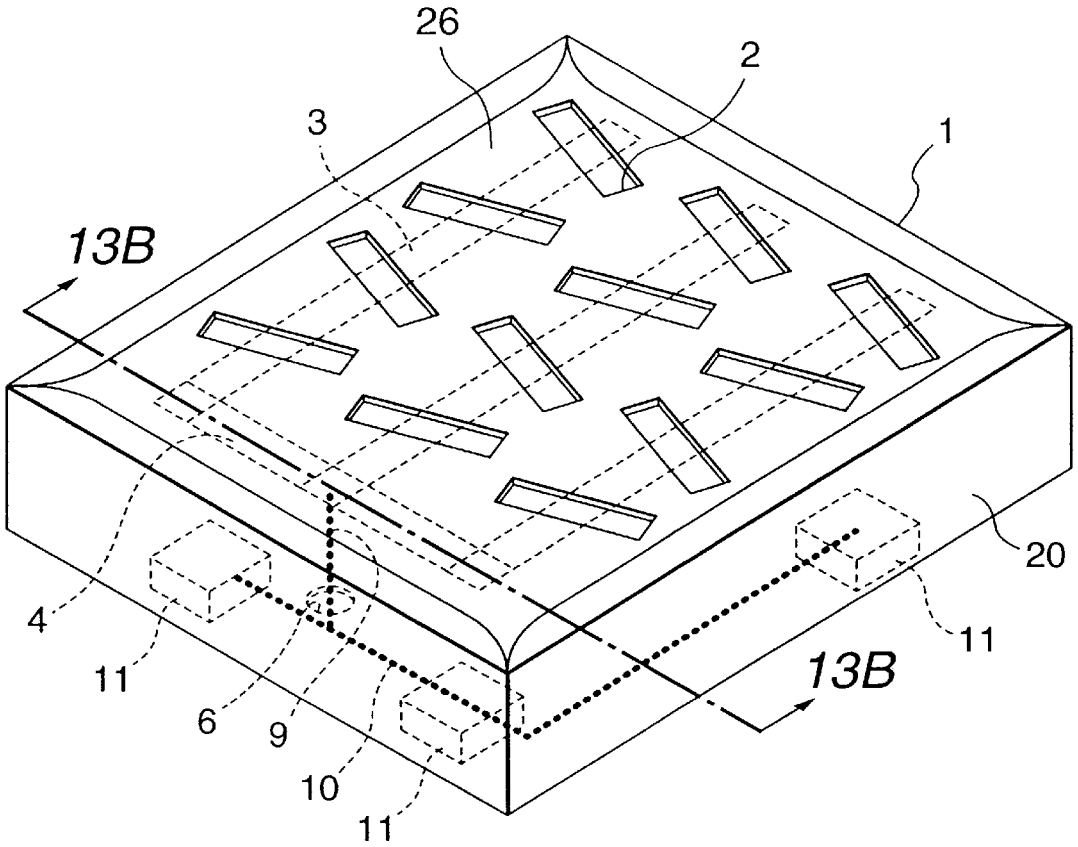
FIG. 13A is a schematic perspective view of a TEM slot antenna in a thirteenth embodiment according to the present invention.
Figure 13B:
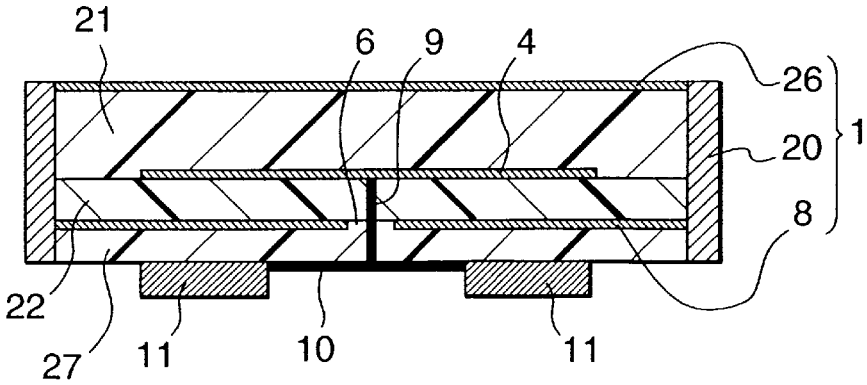
FIG. 13B is a sectional view taken on line 13B—13B in FIG. 13A.

A TEM slot array antenna in a thirteenth embodiment according to the present invention will be described with reference to FIGS. 13A and 13B. FIG. 13A is a schematic perspective view of the TEM slot array antenna and FIG. 13B is a sectional view taken on line 13B—13B in FIG. 13A. The thirteenth embodiment is similar to the third embodiment, but differs from the third embodiment in that a multilayer substrate having four layers is formed by laminating three dielectric substrates 21, 22 and 27, slots 2 and a upper conductive plate 26 are formed in a first layer, i.e., an upper layer, of the multilayer substrate, strip lines 3 and a dividing strip conductor 4 are formed in a second layer of the multilayer substrate, a lower conductive plate 8 and a coupling hole 6 are formed in a third layer, a circuit pattern 10 is formed in a fourth layer, i.e., a back layer, of the multilayer substrate, electronic parts 11 forming a high-frequency circuit are mounted on the fourth layer, and the circuit pattern 10 is connected to a dividing strip conductor 4 by a through hole 9. The TEM slot array antenna can be fabricated by an ordinary multilayer substrate forming process, and the high-frequency circuit can integrally be incorporated into the TEM slot array antenna. Therefore, a high-frequency unit included in a radio apparatus including an antenna can be manufactured at a low cost in a compact construction.

The thicknesses of the dielectric substrates 21 and 22 forming the base of the TEM slot array antenna are greater than the thickness of the dielectric substrate 27 serving as a base for the high-frequency circuit. Since an electromagnetic wave of a TEM mode is induced in and propagates through the dielectric substrates 21 and 22, the loss of dielectric substrates to the electromagnetic wave must be suppressed by using a base of a relatively great thickness. The dielectric substrate 27 serving as the base for the high-frequency circuit needs only to support the high-frequency circuit on its surface and hence the thickness thereof is not important. A desirable integrated structure can be constructed by using the dielectric substrates having the foregoing thicknesses.

The base of the high-frequency circuit may consist of a plurality of substrates of thicknesses smaller than the thickness of the base of the TEM slot array antenna for the same effect.

FOURTEENTH EMBODIMENT

Figure 14A:
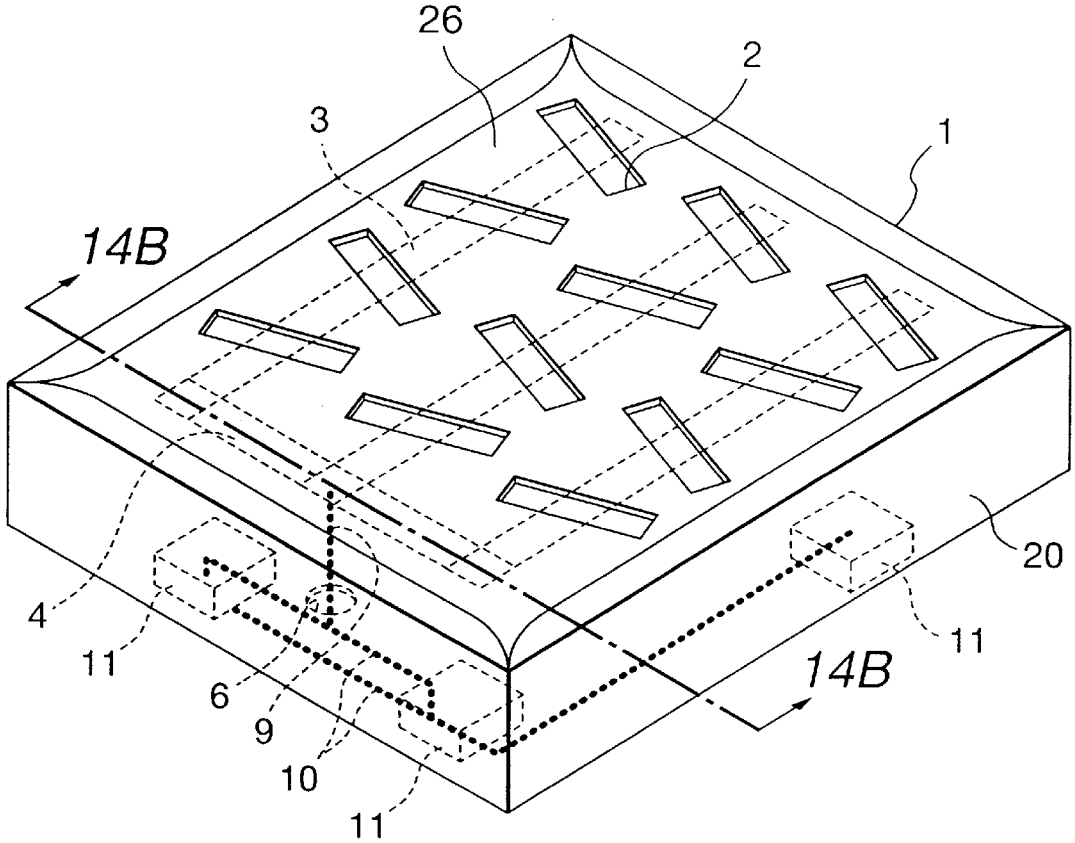
FIG. 14A is a schematic perspective view of assistance in explaining TEM slot antennas in a fourteenth and a fifteenth embodiment according to the present invention.
Figure 14B:
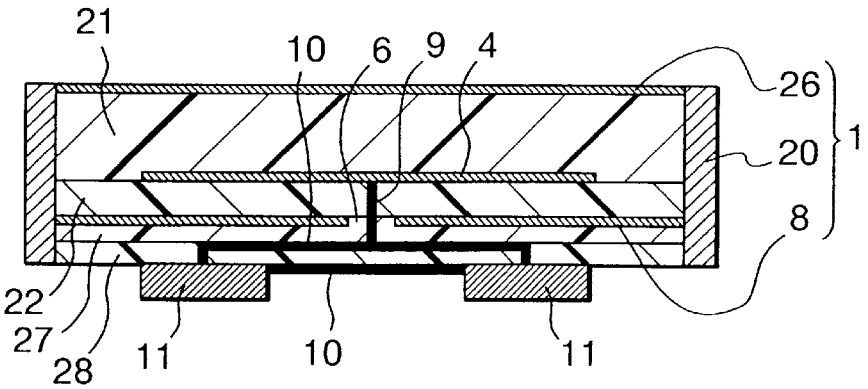
FIG. 14B is a sectional view taken on line 14B—14B in FIG. 14A.

A TEM slot array antenna in a fourteenth embodiment according to the present invention will be described with reference to FIGS. 14A and 14B. FIG. 14A is a schematic perspective view of the TEM slot array antenna and FIG. 14B is a sectional view taken on line 14B—14B in FIG. 14A. The fourteenth embodiment is similar to the thirteenth embodiment, but differs from the thirteenth embodiment in that a multilayer substrate having five layers is formed by laminating four dielectric substrates 21, 22, 27 and 28, slots 2 are formed in a first layer, i.e., an upper layer, of the multilayer substrate, strip lines 3 and a dividing strip conductor 4 are formed in a second layer of the multilayer substrate, a lower conductive plate 8 and a coupling hole 6 are formed in a third layer, a circuit pattern 10 is formed in a fourth layer and a fifth layer, i.e., a back layer, of the multilayer substrate, electronic parts 11 forming a high-frequency circuit are mounted on the fifth layer, and the circuit pattern 10 is connected to a dividing strip conductor 4 by a through hole 9. The TEM slot array antenna in the fourteenth embodiment exercises effects, in addition to those of the thirteenth embodiment as shown in FIGS. 13A and 13B, in forming the high-frequency circuit in a higher density and further miniaturizes the high-frequency unit of a radio apparatus including an antenna.

FIFTEENTH EMBODIMENT

A TEM slot array antenna in a fifteenth embodiment according to the present invention will be described with reference to FIGS. 14A and 14B. The fifteenth embodiment is similar to the fourteenth embodiment, but differs from the fourteenth embodiment in that a material forming dielectric substrates 21 and 22 forming first, second and third layers is different from that forming dielectric substrates 27 and 28 forming fourth and fifth layers on which a high-frequency circuit is formed. A dielectric material for forming a portion of an antenna unit needs to have a dielectric constant nearly equal to that of a free space to suppress the reflection ratio between a dielectric in a slot and a free space; that is, the dielectric material must have a small dielectric constant. Since the size of internal strip lines of the TEM slot array antenna is several times the wavelength, dielectric loss must be small; that is the dielectric loss tangent (tan $\delta$) must be small. On the other hand, a dielectric material for forming a portion of the high-frequency circuit must have a large dielectric constant, because the reflection ratio of the dielectric in contact with a free space must be large to prevent the leakage of the energy of an electromagnetic wave from the high-frequency circuit into the free space. Since the length of strip lines included in the high-frequency circuit is short as compared with the wavelength, the influence of the dielectric material, as compared with that of the dielectric employed in the antenna unit, is insignificant. Therefore, the dielectric loss may be relatively large. Therefore, suitable dielectric members are used in the high-frequency circuit unit and the antenna unit, respectively, to reduce the cost of the high-frequency unit of a radio apparatus including an antenna without deteriorating the performance of the same.

Naturally, even if the number of the substrates of the high-frequency unit is not two, the substrates of the high-frequency circuit unit may be formed of a dielectric material different from that for forming the substrates of the antenna unit for the same effect.

SIXTEENTH EMBODIMENT

Figure 15A:
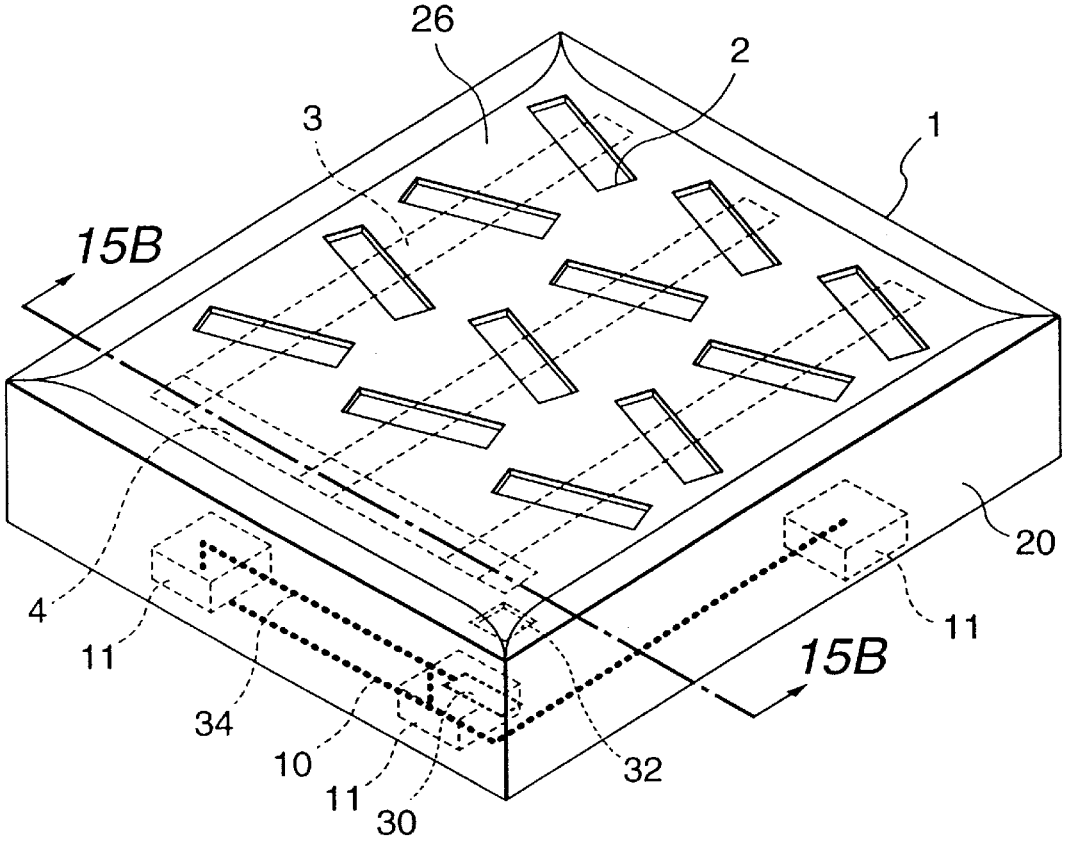
FIG. 15A is a schematic perspective view of a TEM slot antenna in a sixteenth embodiment according to the present invention.
Figure 15B:
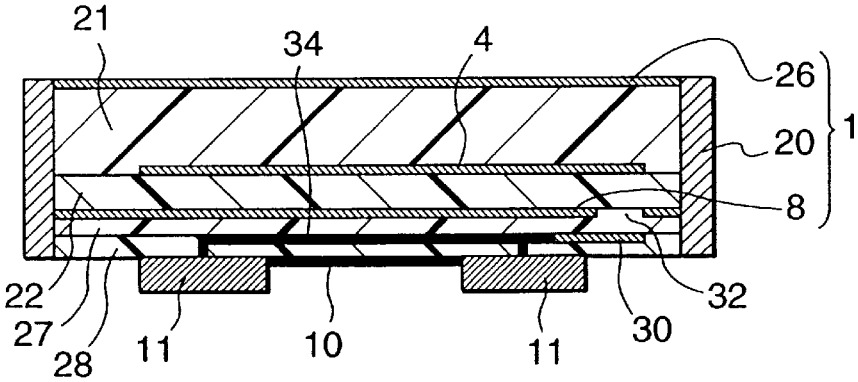
FIG. 15B is a sectional view taken on line 15B—15B in FIG. 15A.

A TEM slot array antenna in a sixteenth embodiment according to the present invention will be described with reference to FIGS. 15A and 15B. FIG. 15A is a schematic perspective view of the TEM slot array antenna, and FIG. 15B is a sectional view taken on line 15B—15B in FIG. 15A. The sixteenth embodiment is similar to the fourteenth embodiment, but differs from the fourteenth embodiment in that high-frequency power generated by a high-frequency circuit is coupled electromagnetically through a coupling hole 32 formed in a lower conductive plate 8 formed in a third layer with a dividing strip conductor 4.

An inner signal line 34 included in the high-frequency circuit, and a feeder strip conductor 30 connected to the inner signal line 34 are formed in a fourth layer. The sizes and positions of the feeder strip conductor 30 and a dividing strip conductor 4 are determined so that the feeder strip conductor 30 and the dividing strip conductor 4 formed respectively on the opposite sides of a coupling hole 32 correspond to each other.

Since power can be supplied to the TEM slot array antenna without using any inner via hole formed within a multilayer substrate, a costly inner via hole forming process can be omitted to reduce the manufacturing cost of the TEM slot array antenna.

As is apparent from the foregoing description of the first to the sixteenth embodiment of the present invention, the TEM slot array antenna of the present invention can be fabricated by ordinary multilayer substrate manufacturing techniques, high-frequency power can be fed through a feeder line not having any branch to a plurality of radiation elements, and the high-frequency circuit can integrally be incorporated into the TEM slot array antenna. Accordingly, a thin planar antenna having a large gain, and a high-frequency unit of a radio apparatus including an antenna can be manufactured at a low cost.

It is further understood by those skilled in the art that the foregoing description is a preferred embodiment of the disclosed device and that various changes and modifications may be made in the invention without departing from the spirit and scope thereof.

What is claimed is:

1. A TEM slot array antenna comprising: a multilayer substrate formed by laminating at least two dielectric substrates and having at least an upper layer, an intermediate layer and a lower layer; an upper conductive plate provided with a plurality of slots and laid in the upper layer; at least one strip line formed in the intermediate layer so as to correspond to the plurality of slots; a lower conductive plate formed in the lower layer; and a dividing strip conductor without branches formed in a portion of the intermediate layer not corresponding to the slots, wherein at least two slots correspond to the strip line, one end portion of each of the at least one strip line is connected to the dividing strip conductor, the dividing strip conductor has a feed point to which a center conductor included in a high-frequency signal transmission line is directly connected, and the lower conductive plate has a grounding point to which a grounding conductor included in the high-frequency signal transmission line is connected.

2. A TEM slot array antenna according to claim 1, wherein the slots are formed in a plurality of slot rows in the upper layer, and a plurality of strip lines are provided, the strip lines respectively corresponding to the slot rows are formed in parallel to each other in the intermediate layer.

3. A TEM slot array antenna according to claim 2, wherein the respective longitudinal axes of the slots on each slot row are inclined at the same angle to the longitudinal axis of the strip line corresponding to the same slot row.

4. A TEM slot array antenna according to claim 2, wherein an angle between the longitudinal axis of the strip line and the longitudinal axis of the slot nearer to the feed point among the plurality of slots on the slot row is smaller than that between the longitudinal axis of the strip line and the longitudinal axis of the slot farther from the feed point among the slots on the same slot row.

5. A TEM slot array antenna according to claim 2, wherein the width of the slot nearer to the feed point among the plurality of slots on each slot row is smaller than that of the slot farther from the feed point among the plurality of slots on the same slot row.

6. A TEM slot array antenna according to claim 2, wherein the interval between the two adjacent slots nearer to the feed point among the plurality of slots on each slot row is greater than that between the two adj acent slots farther from the feed point among the plurality of slots on the same slot row.

7. A TEM slot array antenna according to claim 2, wherein the distance between the center of the slot nearer to the feed point among the plurality of slots on each slot row and the strip line corresponding to the slot row is greater than that between the center of the slot farther from the feed point and the strip line.

8. A TEM slot array antenna according to claim 2, wherein stub strip lines are connected to joints of the dividing strip conductor and the strip lines so as to extend in a direction opposite a direction in which the strip lines extend from the dividing strip conductor.

9. A TEM slot array antenna according to claim 2, wherein the multilayer substrate comprises three dielectric substrates.

10. A TEM slot array antenna according to claim 2, wherein the dividing strip conductor is formed in a region not corresponding to the slots of the intermediate layer and is connected to the middle portions of the strip lines, and the feed point is at a position on the dividing strip conductor.

11. A TEM slot array antenna according to claim 10, wherein the width of the strip lines corresponding to the slots is smaller than that of the dividing strip conductor.

12. A TEM slot array antenna according to claim 2, further comprising a circuit supporting plate comprising at least one dielectric substrate for supporting a circuit thereon attached to the lower layer in which the lower conductive plate is formed.

13. A TEM slot array antenna according to claim 12, wherein the circuit supporting plate comprises a single dielectric substrate for supporting a circuit, a circuit pattern is formed and electronic parts are mounted on a back surface of the single dielectric substrate opposite to the lower conductive plate so as to form a high-frequency circuit, and a through hole for feeding a high-frequency signal generated by the high-frequency circuit to the feed point is formed across the intermediate layer and the surface on which the circuit pattern is formed.

14. A TEM slot array antenna according to claim 12, wherein the circuit supporting plate is formed by laminating a plurality of dielectric substrates for supporting a circuit, inner conductive plates are formed in layers between the laminated dielectric substrates, respectively, and through holes for electrically connecting the inner conductive plates in the layers to the circuit patterns formed on a back surface of the laminated dielectric substrates opposite to the lower conductive plate are formed.

15. A TEM slot array antenna according to claim 12, wherein the thickness of the dielectric substrate on the side of the slots with respect to the lower conductive plate is greater than that of said at least one dielectric substrate for supporting the circuit.

16. A TEM slot array antenna according to claim 12, wherein the material of the dielectric substrate on the side of the slots with respect to the lower conductive plate is different from that of said at least one dielectric substrate for supporting the circuit.

17. A TEM slot array antenna according to claim 16, wherein the dielectric constant of the dielectric substrate on the side of the slots with respect to the lower conductive plate is smaller than that of said at least one dielectric substrate for supporting the circuit.

18. A TEM slot array antenna according to claim 16, wherein the dielectric loss tangent of the dielectric substrate on the side of the slots with respect to the lower conductive plate is smaller than that of said at least one dielectric substrate for supporting the circuit.

19. A TEM slot array antenna according to claim 1, wherein the slots are formed in a plurality of slot rows, the respective longitudinal axes of the two adjacent slots on each of the plurality of slot rows intersect each other at right angles, and a straight line bisecting the angle between the two adjacent slots on each slot row extends perpendicularly to the strip line corresponding to the slot row.

20. A TEM slot array antenna according to claim 19, wherein the respective longitudinal axes of the corresponding slots on the two adjacent slot rows are inclined at different angles to the corresponding slot rows, respectively.

21. A TEM slot array according to claim 1, wherein the width of the at least one strip line corresponding to the slots is smaller than that of the dividing strip conductor.

22. A TEM slot array antenna according to claim 1, wherein the feed point is placed at one end of the dividing strip conductor.

23. A TEM slot array antenna according to claim 1, wherein at least one protective layer is formed over the upper layer.

24. A TEM slot array antenna according to claim 1, wherein each of the at least one strip line is directly connected to the dividing strip conductor.

25. A TEM slot array antenna according to claim 1, wherein a plurality of strip lines are formed in the intermediate layer, the plurality of strip lines extending in a parallel arrangement to one another so as to correspond to the plurality of slots, and the dividing strip conductor is a single dividing strip conductor extending in an orthogonal direction to the parallel arrangement of the plurality of strip lines with the plurality of strip lines being directly connected to the single dividing strip conductor.

26. A TEM slot array antenna according to claim 25, wherein one end of each of the plurality of strip lines is connected to the single dividing strip conductor, the single dividing strip line conductor being a linear dividing strip line conductor extending substantially perpendicular to the plurality of strip lines.

27. A TEM slot array antenna according to claim 1, wherein the upper conductive plate is the top plate of the TEM slot array through which the slots thereof an electromagnetic wave is radiated outwardly of the TEM slot array antenna and the lower conductive plate is a bottom plate of the TEM slot array antenna.

* * * * *